US007210824B2

(12) United States Patent
Lu

(10) Patent No.: US 7,210,824 B2
(45) Date of Patent: May 1, 2007

(54) COLLAPSIBLE LAMPSHADE STRUCTURE

(76) Inventor: Chin-Lung Lu, 16F., No. 313, Chung Hua Rd., Shu Lin City, Taipei Hsien (TW)

( * ) Notice: Subject to any disclaimer, the term of this patent is extended or adjusted under 35 U.S.C. 154(b) by 0 days.

(21) Appl. No.: 11/267,149

(22) Filed: Nov. 7, 2005

(65) Prior Publication Data

US 2006/0109659 A1 May 25, 2006

(30) Foreign Application Priority Data

Nov. 10, 2004 (TW) ..... 93217930 U

(51) Int. Cl.
*F21V 1/06* (2006.01)
*F21V 11/00* (2006.01)
*F21V 17/00* (2006.01)

(52) U.S. Cl. ..... 362/352; 362/353; 362/431; 362/452

(58) Field of Classification Search ..... 362/351, 362/352, 353, 410, 430, 450, 451, 452; 24/293–295, 24/297, 545
See application file for complete search history.

(56) References Cited

U.S. PATENT DOCUMENTS 7,086,760 B2 * 8/2006 Chuang ..... 362/351
2004/0228132 A1 * 11/2004 Sun ..... 362/352

* cited by examiner

*Primary Examiner*—John Anthony Ward
(74) *Attorney, Agent, or Firm*—Leong C. Lei

(57) ABSTRACT

A collapsible lampshade structure which includes an upper fixing ring provided with a plurality of engaging members, a lower fixing ring provided with a plurality of engaging seats and two pairs of tubular members, and a plurality of resilient ribs each having a projection at an upper end thereof and two pins at a lower end thereof, the ribs being detachably connected between the engaging members of the upper fixing ring and the engaging seats of the lower fixing rings, a first curved rod mounted between a pair of the tubular members and having a first recess, a second curved rod mounted between another pair of the tubular members and having a second recess, and a retainer formed with two hooks adapted to be engaged with the recesses of the curved rods, one of the hooks having two protuberances for preventing the retainer from detaching from the second curved rod.

2 Claims, 9 Drawing Sheets

COLLAPSIBLE LAMPSHADE STRUCTURE

BACKGROUND OF THE INVENTION

1. Field of the Invention

This invention is related to a collapsible lamp shade structure and in particular to one comprising an upper fixing ring, a lower fixing ring, and a plurality of ribs which can be easily assembled to form a lamp shade and dismantled to reduce its volume, thereby facilitating its transporting, and making it easier for packaging purposes.

2. Description of the Prior Art

The conventional lamp shade (see FIG. 1) is composed of an upper fixing ring, a lower fixing ring, and a plurality of ribs which are welded between the upper and the lower fixing rings, and a cloth hood which is mounted on the outside of the frame and a lining is mounted inside the frame. However, this kind of lampshade cannot be dismantled or collapsed, and so it is bulky in volume, making it difficult for packaging and difficult for transportation.

Therefore, it is an object of the present invention to provide an improved lampshade structure which can obviate and mitigate the above-mentioned drawbacks.

SUMMARY OF THE INVENTION

This invention is related to a collapsible lamp shade structure comprising an upper fixing ring, a lower fixing ring, and a plurality of ribs which can be easily assembled to form a lampshade and dismantled to reduce its volume.

According to the present invention, there is provided a collapsible lampshade structure which includes an upper fixing ring provided with a plurality of engaging members, a lower fixing ring provided with a plurality of engaging seats and two pairs of tubular members, and a plurality of resilient ribs each having a projection at an upper end thereof and two pins at a lower end thereof, the ribs being detachably connected between the engaging members of the upper fixing ring and the engaging seats of the lower fixing rings, a first curved rod mounted between a pair of the tubular members and having a first recess, a second curved rod mounted between another pair of the tubular members and having a second recess, and a retainer formed with two hooks adapted to be engaged with the recesses of the curved rods, one of the hooks being provided with two protuberances for preventing the retainer from detaching from the second curved rod, whereby the lampshade can be easily collapsed into a flat shape so that the volume of the lamp shades can be reduced, thereby facilitating packaging and transportation.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
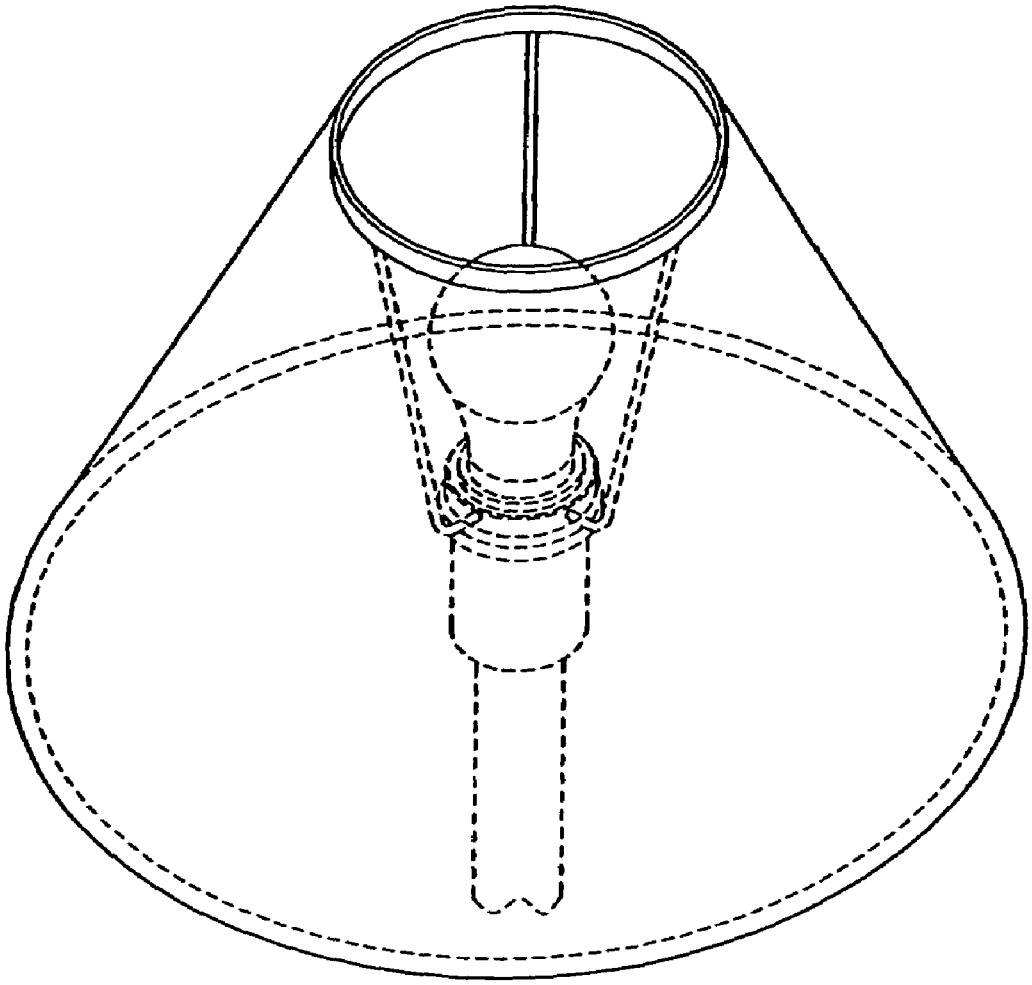
PRIOR ART FIG. 1
FIG. 1 is a perspective view of a conventional lampshade.
Figure 2:
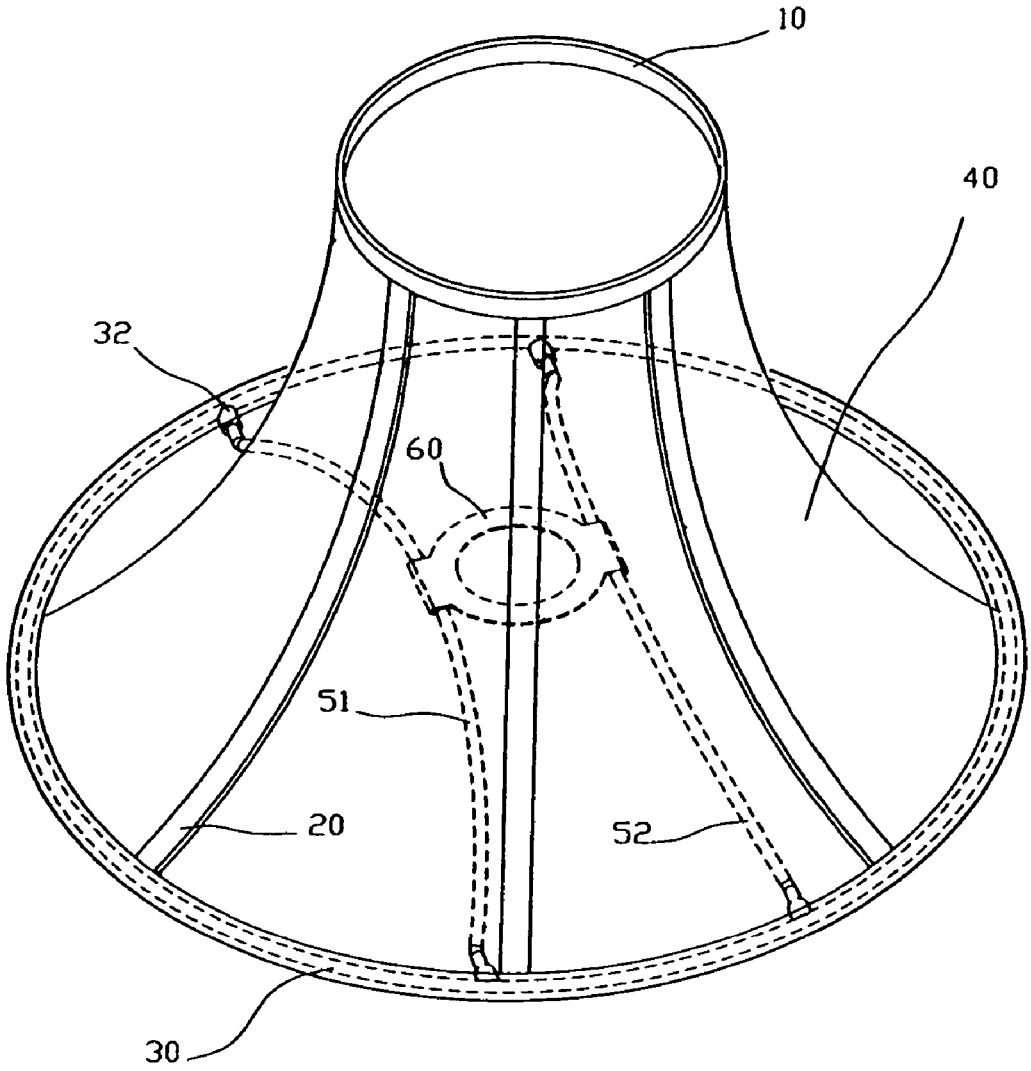
FIG. 2 is a perspective view of an improved lampshade according to the present invention.
Figure 3:
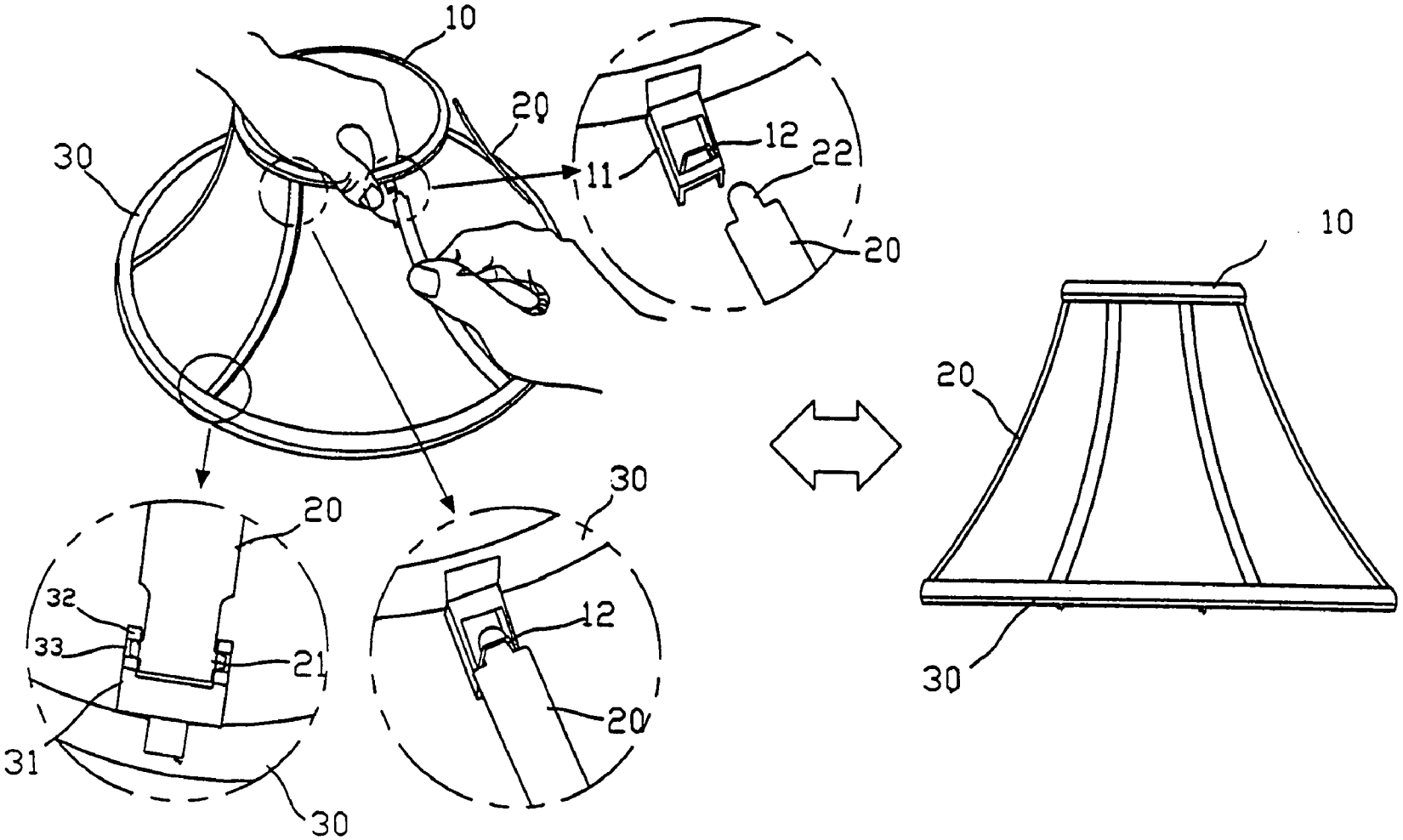
FIG. 3 illustrates the procedures to assemble the improved lampshade according to the present invention.
Figure 4:
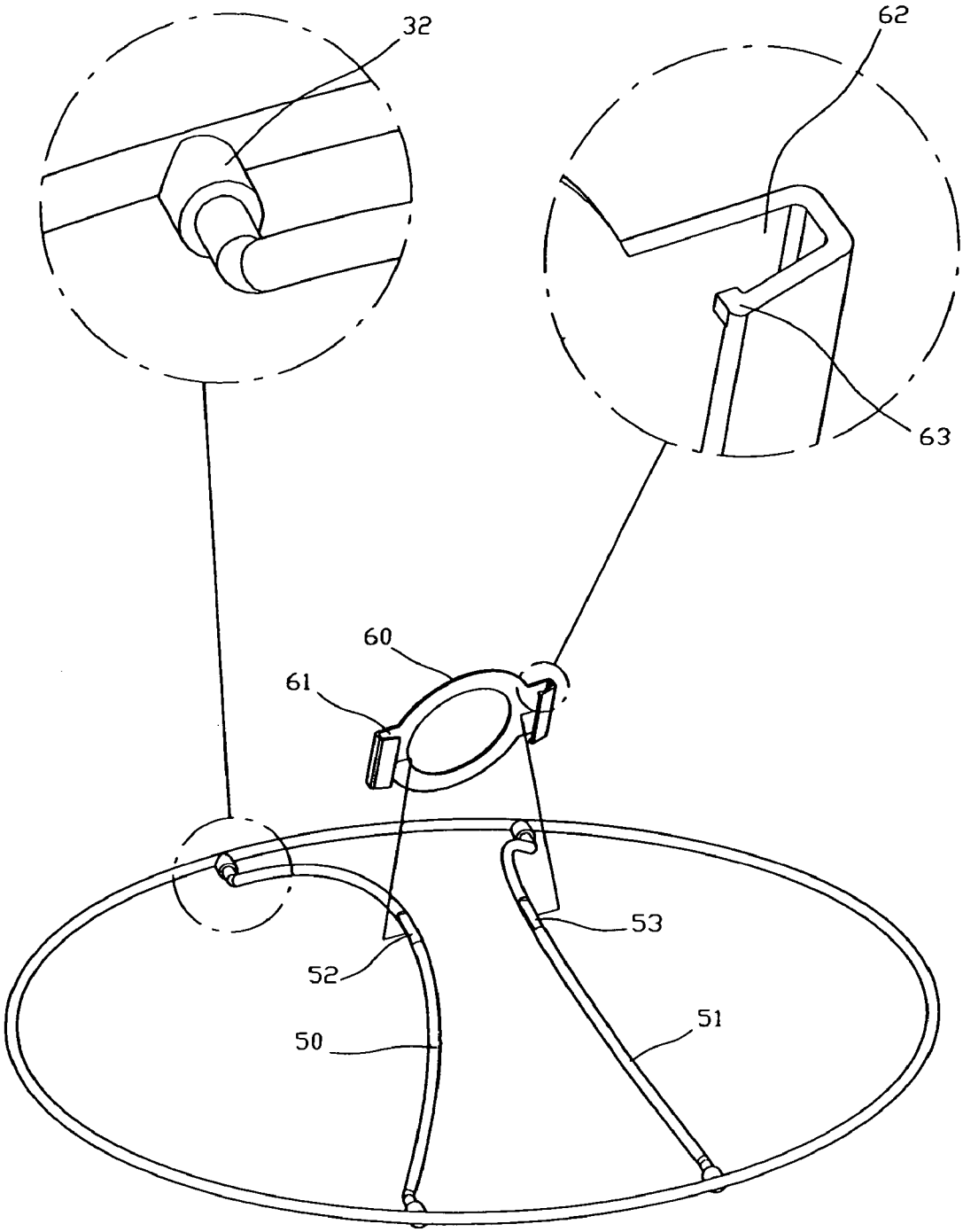
FIG. 4 illustrates the procedures to engage the retainer with the supporting rods.
Figure 5A:
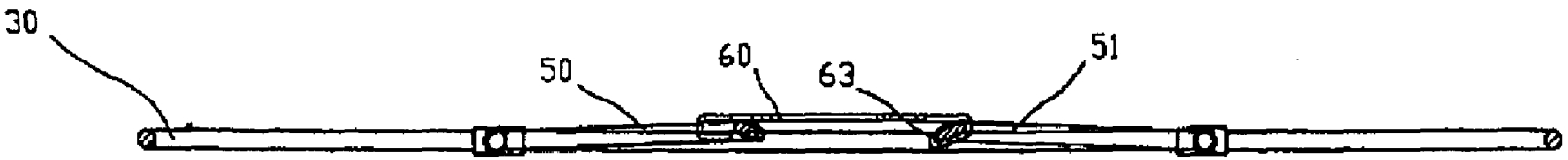
FIGS. 5A and 5B illustrate the engagement between the retainer and the supporting rods.
Figure 5B:
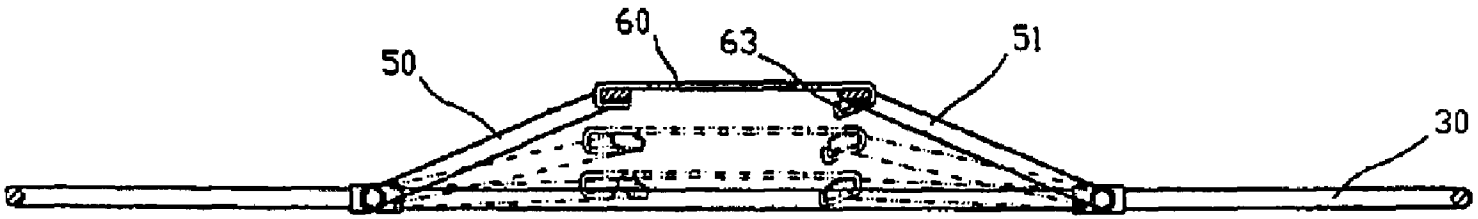

Referring to FIGS. 2 and 3, the improved lampshade structure according to the present invention comprises an upper fixing ring 10, a lower fixing ring 30, a plurality of resilient ribs 20, a first curved rod 50, a second curved rod 51, a retainer 60, and a cloth hood 40.

The upper fixing ring 10 is smaller than the lower fixing ring 30 in diameter. The upper fixing ring 10 is provided with a plurality of engaging member 11 which are inverted U-shaped members each formed with a trapezoid outwardly extending lug 12 having a hole. The lower fixing ring 30 is provided with a plurality of engaging seats 31, each having two side flanges 32 each having a hole 33 for receiving a pin 21 provided at an upper end of the rib 20. The other end of the rib 20 has a projection 22 adapted to engage with the hole of the trapezoid lug 13 of the engaging member 11.

Referring to FIGS. 2, 4, 5A and 5B, the lower fixing ring 30 is provided with two pairs of tubular members 32. The tubular members 32 of the same pair are aligned with each other. Each of the curved rods 50 and 51 is mounted between a pair of the tubular members 32. The curved rods 50 and 51 are formed with recesses 52 and 53, respectively. The retainer 60 is formed with two hooks 61 and 62 adapted to be engaged with the recesses 52 and 53 of the curved rods 50 and 51. The hook 62 is provided with two protuberances 63 for preventing the retainer 60 from detaching from the curved rod 51.

When in assembly, the ribs 20 are mounted between the upper fixing ring 10 and the lower fixing ring 30, so that the projection 22 of the ribs 20 is engaged with the hole of the trapezoid lug 13, while the pins 21 at the other end of the rib are engaged with the engaging seat 31. Then, the cloth hood and the inner lining are mounted on the outer and inner side of the lampshade structure by any suitable known means.

Figure 7:
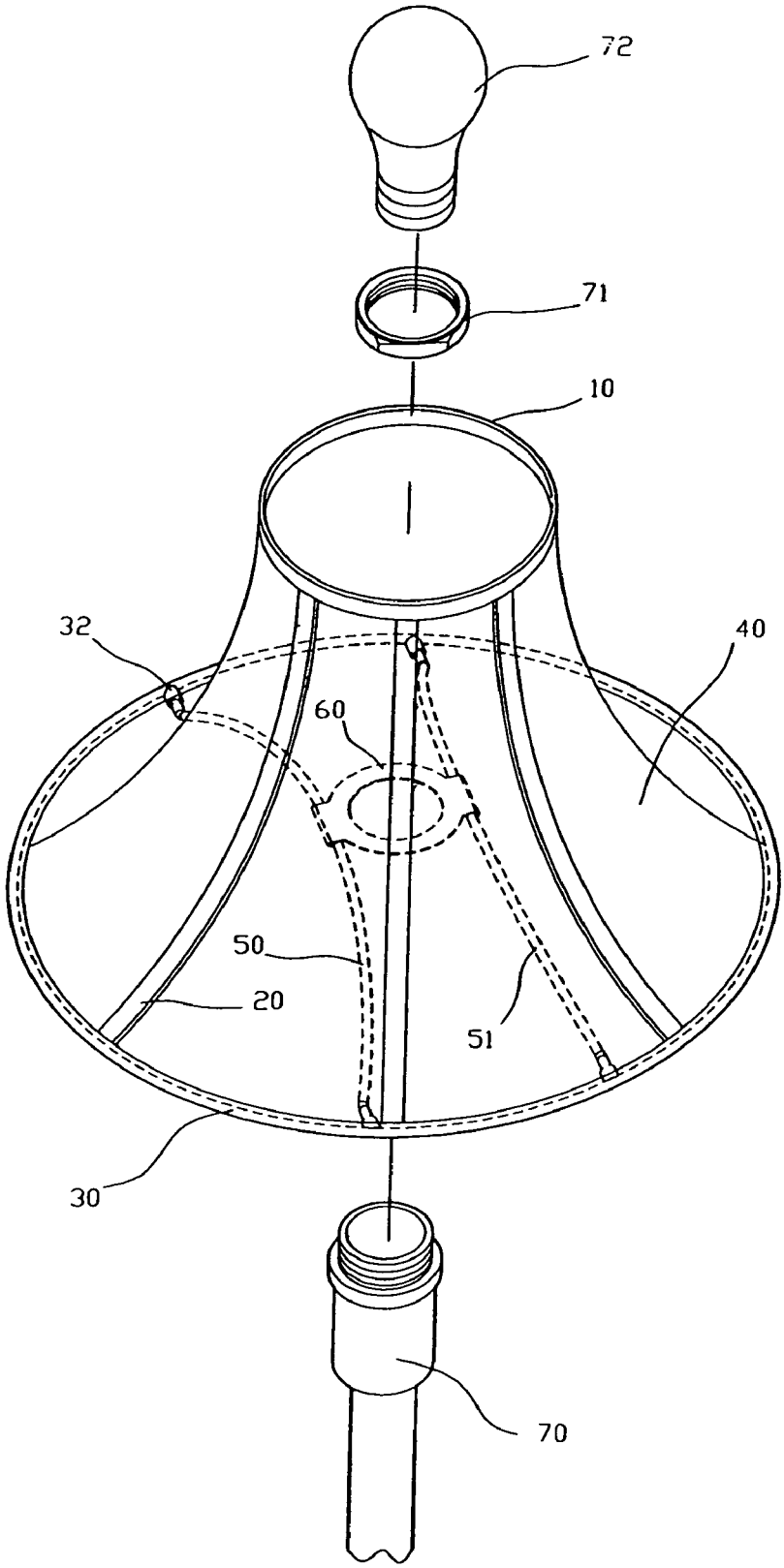
FIG. 7 illustrates how an electrical socket is engaged with the present invention.
Figure 8:
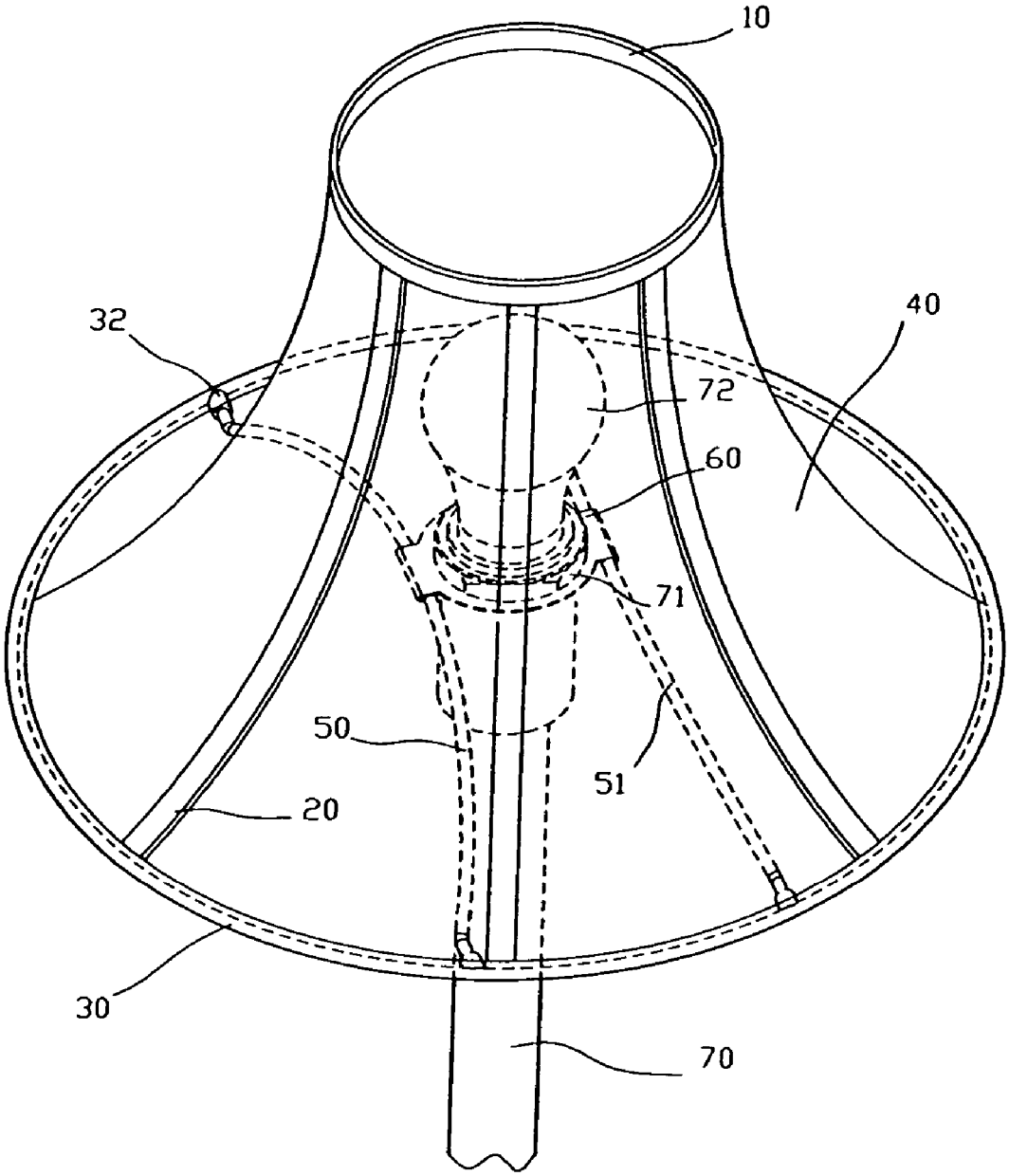
FIG. 8 illustrates the engagement of the improved collapsible lampshade with a lamp socket.

Thereafter, the curved rods 50 and 51 are mounted between the tubular members 32 and the retainer 60 is engaged with the curved rods 50 and 51. Finally, an electrical socket 70 is mounted on the retainer 60 by a nut 71 for engaging a light bulb 72 (see FIGS. 7 and 8).

Figure 6:
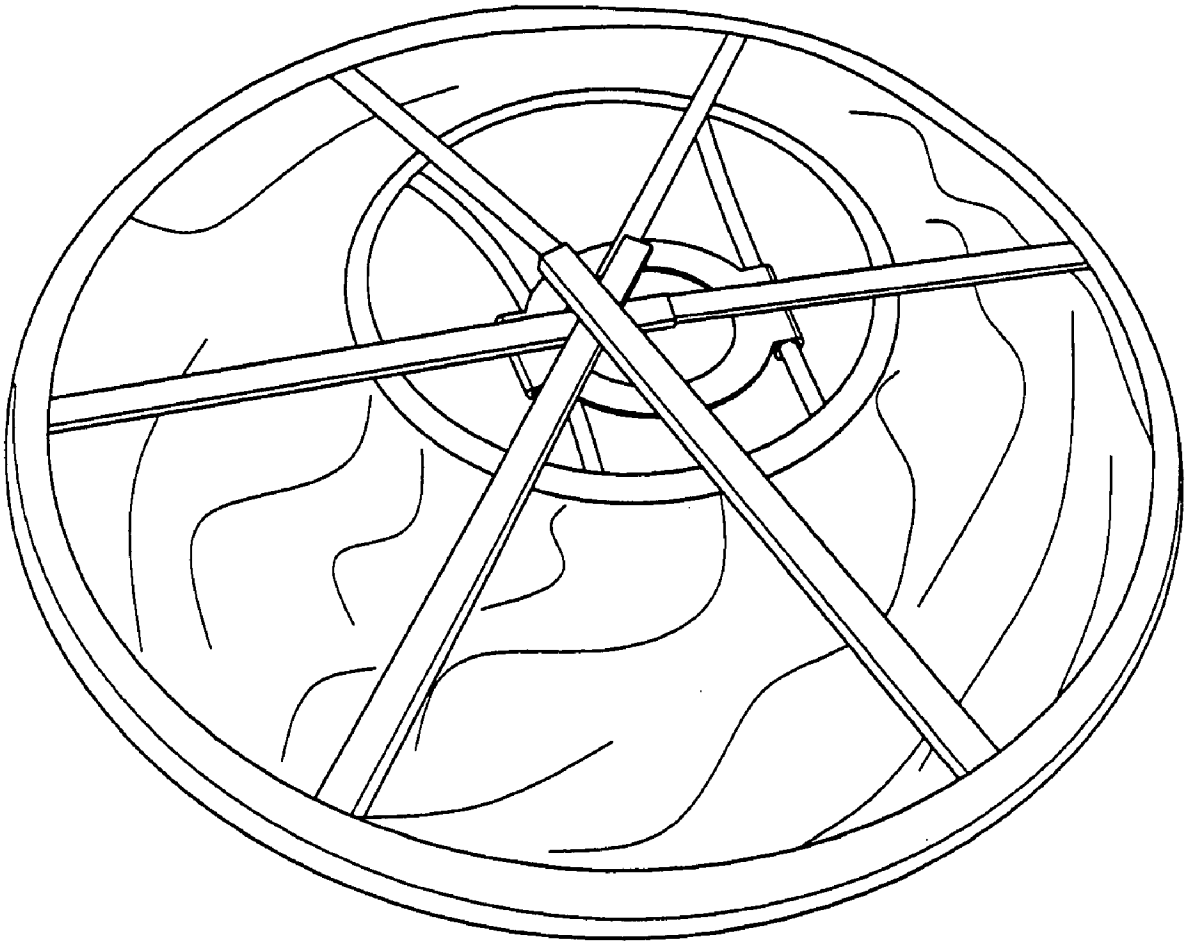
FIG. 6 illustrates the collapsible state of the improved collapsible lampshade according to the present invention.

When desired to collapse the lampshade for stowage or transportation, it is only necessary to apply force to the rib 20 so as to make the projection 22 to disengage from the hole of the trapezoid lug 13 of the engaging member 11. Then, the upper fixing ring 10, the lower fixing ring 30, the retainer 60, and the curved rods 50 and 51 are collapsed and the left hook 61 of the retainer 60 will be detached from the left curved rod 50. Thereafter, the component parts may be collapsed together with the cloth hood to form a flat shape (see FIG. 6), so that the volume of the lamp shades can be reduced, thereby facilitating packaging and transportation.

Figure 9:
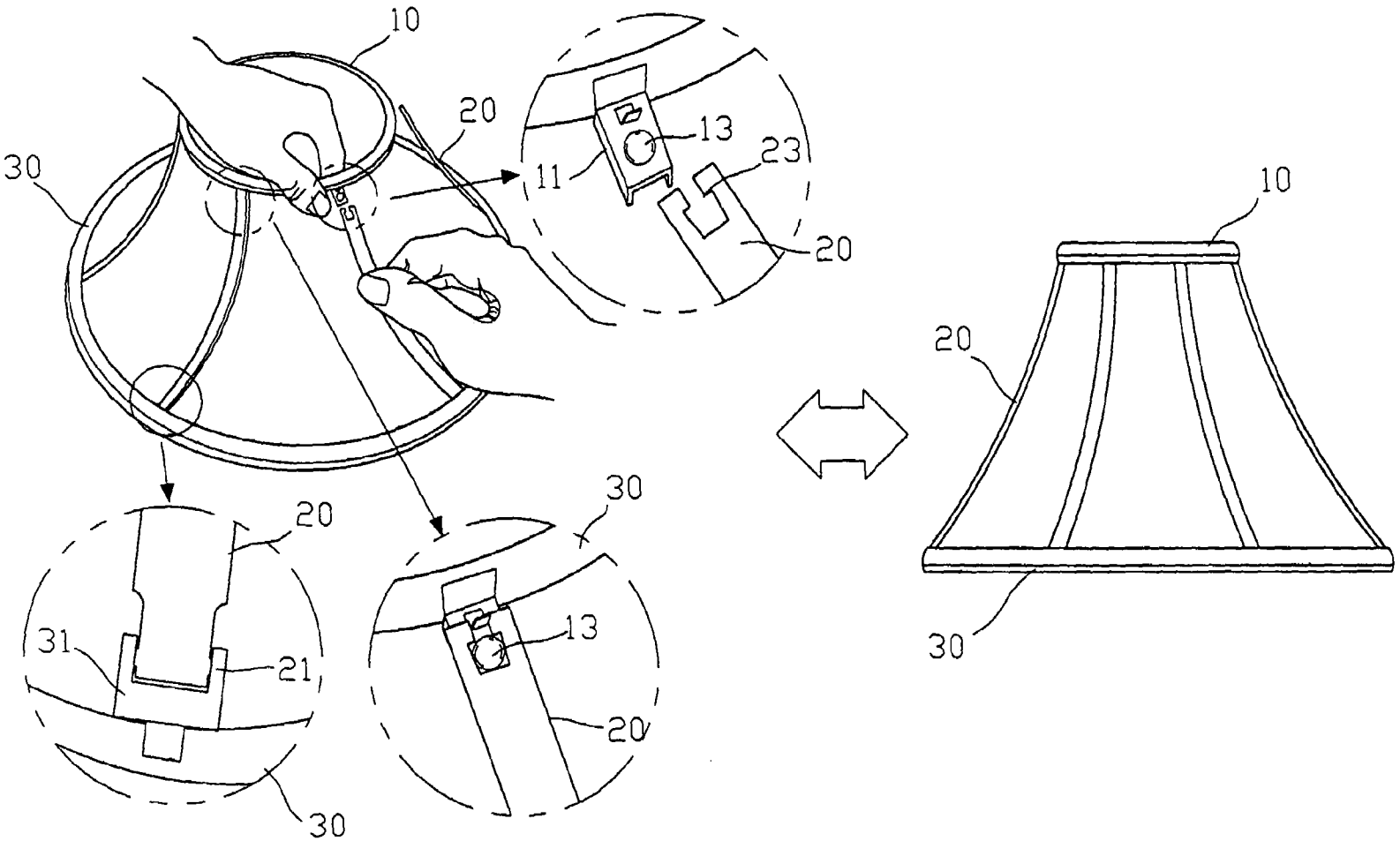
FIG. 9 illustrates the procedures to assemble the improved lampshade according to a second preferred embodiment of the present invention.

FIG. 9 illustrates a second preferred embodiment of the present invention. As shown, the engaging member 11 of the upper fixing ring 10 is provided with a ball-shaped element 13. The upper end of the rib 20 has a recess 23 which is narrow at the entrance, and the inner portion is dimensioned to receive the ball-shaped element 14.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A collapsible lampshade structure comprising:

an upper fixing ring provided with a plurality of engaging members;

a lower fixing ring provided with a plurality of engaging seats and two pairs of tubular members; and a plurality of resilient ribs each having a projection at an upper end thereof and two pins at a lower end thereof, said ribs being detachably connected between said engaging members of said upper fixing ring and said engaging seats of said lower fixing rings;

a first curved rod mounted between a pair of said tubular members and having a first recess;

a second curved rod mounted between another pair of said tubular members and having a second recess; and a retainer formed with two hooks adapted to be engaged with said recesses of said curved rods, one of said hooks being provided with two protuberances for preventing said retainer from detaching from said second curved rod.

2. The collapsible lampshade structure as claimed in claim 1, wherein each of said engaging members is provided with a ball-shaped element and each of said resilient ribs has an end formed with a recess dimensioned to engage with said ball-shaped element.

* * * * *